United States Patent [19]

Sisemore

[11] 4,219,237

[45] Aug. 26, 1980

[54] METHOD FOR MAXIMIZING SHALE OIL RECOVERY FROM AN UNDERGROUND FORMATION

[75] Inventor: Clyde J. Sisemore, Livermore, Calif.

[73] Assignee: The United States of America as represented by the United States Department of Energy, Washington, D.C.

[21] Appl. No.: 838,274

[22] Filed: Sep. 30, 1977

[51] Int. Cl.[2] ..... E21C 41/10; E21C 43/00

[52] U.S. Cl. ..... 299/2; 299/11; 299/19

[58] Field of Search ..... 299/2, 11, 19; 61/35; 166/256, 259

[56] References Cited

U.S. PATENT DOCUMENTS

| | | | |
|---|---|---|---|
| 1,004,419 | 9/1911 | Griffith | 299/11 |
| 3,459,003 | 8/1969 | O'Neal | 61/35 |
| 3,527,500 | 9/1970 | Thompson | 299/11 |
| 3,588,175 | 6/1971 | Whiting | 299/11 |
| 4,017,119 | 4/1977 | Lewis | 299/2 |
| 4,120,355 | 10/1978 | Knepper | 166/259 |

*Primary Examiner*—William F. Pate, III

*Attorney, Agent, or Firm*—James E. Denny; Harold M. Dixon; Irene S. Croft

[57] ABSTRACT

A method for maximizing shale oil recovery from an underground oil shale formation which has previously been processed by in situ retorting such that there is provided in the formation a column of substantially intact oil shale intervening between adjacent spent retorts, which method includes the steps of back filling the spent retorts with an aqueous slurry of spent shale. The slurry is permitted to harden into a cement-like substance which stabilizes the spent retorts. Shale oil is then recovered from the intervening column of intact oil shale by retorting the column in situ, the stabilized spent retorts providing support for the newly developed retorts.

5 Claims, 5 Drawing Figures

METHOD FOR MAXIMIZING SHALE OIL RECOVERY FROM AN UNDERGROUND FORMATION

BACKGROUND OF THE INVENTION

The invention described herein was made at Lawrence Livermore Laboratory under United States Energy Research and Development Administration Contract No. W-7405-ENG-48 with the University of California.

This invention relates to a method for maximizing the recovery of shale oil from an underground oil shale formation. More particularly, this invention relates to a method for recovering shale oil from a column of substantially intact oil shale which remains between spent retorts in a formation which has previously been processed by in situ retorting.

Many of the potentially most productive oil shales are covered by deep overburdens and are not readily amenable to mining. Considering current day liquid fuel requirements it is essential that a practical in situ technique be developed for processing underground oil shales for maximum recovery of shale oil therefrom. Basically, underground processing involves first, some method of introducing permeability into the formation, and, second, some method of heat injection that will cause pyrolysis of the organic matter in the shale to yield useful products.

Permeability is best introduced into the formation by rubblization, a process which introduces both fractures and void space into the oil shale. One method for creating an underground rubble region involves providing a void space by mining a fraction of the oil shale and then distributing this void space in the rubble to obtain the necessary permeability for retorting. For example, a modified sublevel-caving method of mining has been proposed to produce oil shale rubble suitable for in situ retorting on a commercial scale. The proposed method is described in detail in the report UCRL-51768, "Rubble In Situ Extraction (RISE): A Proposed Program for Recovery of Oil from Oil Shale", by A. E. Lewis and A. J. Rothman, Mar. 5, 1975, available from National Technical Information Service, U.S. Department of Commerce, 5285 Port Royal Road, Springfield, Virginia 22151, which report is incorporated herein by reference. An improvement in this method is described in detail in U.S. Pat. No. 4,017,119, issued Apr. 12, 1977, to Arthur E. Lewis, for "Method for Rubblizing An Oil Shale Deposit for In Situ Retorting", which is also incorporated herein by reference. The oil shale removed from the formation in order to create the necessary void space can be surface retorted for recovery of oil.

Retorting of the rubblized oil shale is then accomplished by causing hot gases to flow through the shale to decompose the kerogen therein and release the oil by techniques which are well known in the art. Upon completion of the retorting operation the retort becomes spent or burned out. Spent shale consists mainly of CaO and MgO plus various clays and silicates. This mineral residue has very low mechanical strength and is also highly permeable. It has, therefore, been proposed to space the in situ retorts with intervening columns of intact shale to support the overburden and minimize subsidence. These columns of intact shale can also serve as permeation barriers to passage of toxic gases between working retorts and adjacent retorts being developed by miners. In addition, the intact shale columns can act as permeation barriers to the passage of ground water into spent or burned out retorts, thereby minimizing contamination of aquifiers by minerals leached from the spent shale.

About half of the oil shale originally in the stratum must be left intact, and hence unavailable for retorting, to provide for overburden support and permeation barriers as discussed above. Resource recovery is therefore about 50%. Thus, the need exists for a method of maximizing recovery of shale oil from underground deposits.

SUMMARY OF THE INVENTION

Briefly, the present invention is a method for maximizing shale oil recovery from an underground oil shale deposit which has been processed by in situ retorting such that columns of substantially intact oil shale remain in the deposit between spent retorts. The present process provides a method of recovering shale oil from such remaining intact oil shale columns whereby adjacent spent retorts are filled with an aqueous slurry of burned spent shale such as may be obtained from a surface retorting operation, and the slurry is permitted to harden into a cement-like material which stabilizes the spent retorts against overburden pressure and side pressure from adjacent retorts. The hardened cement-like material provides an effective gas/liquid permeation barrier between adjacent retorts. The intervening columns of intact shale are then developed for in situ retorting. Thus, shale which was formerly required to be left intact is made available for retorting, increasing resource recovery to essentially 100%. The present invention also provides a convenient route for disposing of spent shale from a surface retorting process.

It is an object of this invention to provide a method for enhancing resource recovery from an underground formation.

More particularly, it is an object of this invention to provide a method for maximizing shale oil recovery from an underground formation, particularly an underground formation which has previously been processed by in situ retorting such that there is provided in the formation a column of substantially intact oil shale intervening between adjacent spent retorts.

It is a further object of this invention to provide a method for recovering shale oil from a substantially intact shale column intervening between adjacent spent retorts in an underground formation.

Other objects and advantages will become apparent from the following detailed description made with reference to the accompanying drawings.

BRIEF DESCRIPTION OF THE DRAWINGS

FIG. 1 represents a spaced array of retorts established in an oil shale stratum.

FIG. 2 represents the stratum after fracturing of the oil shale in the retorts.

FIG. 3 represents the stratum after retorting of the fractured oil shale.

FIG. 4 represents the stratum after spent retorts have been backfilled with an aqueous slurry of burned spent shale.

FIG. 5 represents the stratum after fracturing of intervening columns of intact shale to form new retorts between burned out retorts.

DETAILED DESCRIPTION OF THE INVENTION

Broadly, the present invention comprises stabilizing underground spent retorts so that intervening columns of substantially intact, unretorted material can be developed for further resource recovery.

Herein, the term "spent retort" is used to include burned out retorts. For example, in the oil shale retorting art, various methods for decomposing the kerogen in the oil shale and releasing the oil therein are well known. The depleted shale is referred to as spent shale. Certain retorting techniques utilize combustion of the carbonaceous content of the spent shale for providing at least a portion of the heat required for the retorting process and in such cases the term "burned-out" retort is often used.

As stated above, the spent retorts are stabilized by filling with an aqueous slurry of burned spent shale, which is obtainable from a surface retorting operation. It is well known in the art that burned spent shale, also referred to as shale ash, attains a cohesive strength due to pozzolanic activity when it is moistened. The cementing properties of waste shale ash are described in detail in the technical report PB-234 208, "Disposal and Uses of Oil Shale Ash", Denver Research Institute, prepared for the Department of the Interior, April 1970, and available from the National Technical Information Service at the address given above, which report is incorporated herein by reference. Preferably, the burned spent shale from which the aqueous slurry is prepared is obtained from surface retorting of oil shale initially removed from the formation in the course of developing the original in situ retorts as will be described more fully hereinafter. If desired, the cementing qualities of the slurry can be improved by adding a cement thereto, such as Portland cement.

In accordance with the present invention, the backfilled cemented retorts are used as pillars to support new retorts therebetween for recovery of additional shale oil from the formation.

Figure 1:
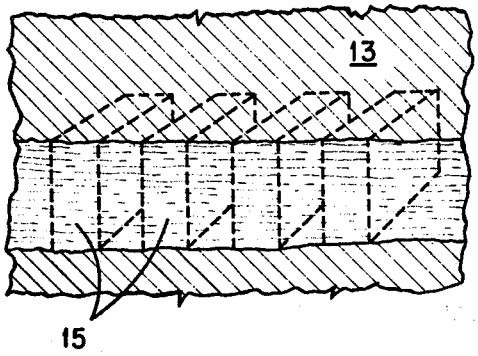
FIGS. 1 through 5 are a diagrammatic representation of a process sequence in accordance with a specific embodiment of the invention.

Referring now to FIG. 1, numeral 13 refers to an oil shale deposit being prepared for initial in situ retorting. There is shown in the figure an array of blocks 15 of shale deposit which are to be developed for in situ retorting. Typical dimensions of each block 15 are 150'×600'×1000' and the blocks are typically spaced 150' apart. Preferably, shale blocks 15 are developed for in situ retorting by subsurface mining, as by the modified sublevel-caving method described in the above-referenced report UCRL-51768 and Lewis U.S. Pat. No. 4,017,119 with a void space being created initially in each block by mining out a portion of the shale. The mined-out shale is surface retorted for recovery of shale oil providing spent shale for the subsequent stabilization operation.

Figure 2:
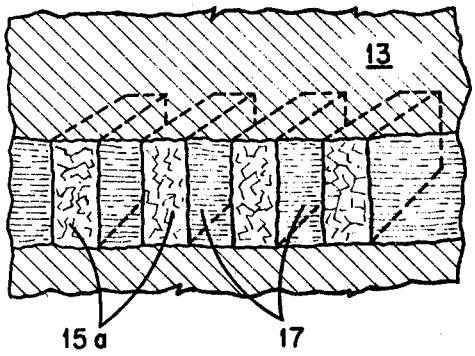

FIG. 2 shows the rubble regions **15*a* resulting from the modified sublevel-caving operation with intervening column 17** of substantially intact shale. The rubblized region is then retorted in situ by any of the methods well known in the art; the necessary conduits for inlet gases, product oil and product gases are not shown. A particularly suitable method for in situ retorting involves igniting the oil shale at the top, then advancing the combustion zone in a generally vertically downward direction by continuous or intermittent injection of an oxygen-containing gas, preferably air. The hot gases from the combustion zone provide the heat necessary to retort the rubblized oil shale below the combustion front. In order to minimize plastic flow of hot rubblized oil shale below the combustion zone, water and carbon dioxide may be introduced into the burned spent shale in amounts sufficient to react with the mineral constituents of the spent shale and form a cement-like material which binds the individual shale particles together and to the wall of the retort, as described in detail in the copending application of Arthur E. Lewis et al, Ser. No. 804,194, filed June 26, 1977, for "Method for Minimizing Plastic Flow of Oil Shale During In Situ Retorting". While this cementation operation is suitable for relieving the burden of the weight of the burned shale on the hot rubblized shale, it is not sufficient for stabilizing the burned out retort for further development of the shale formation in accordance with the present invention.

Figure 3:
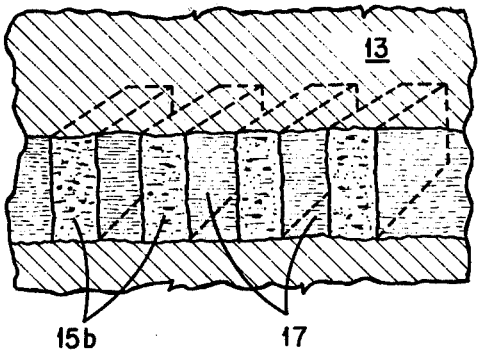
Figure 4:
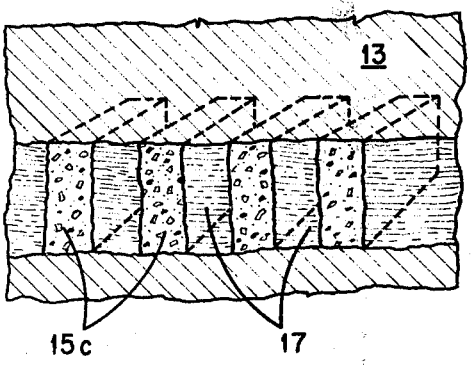
Figure 5:
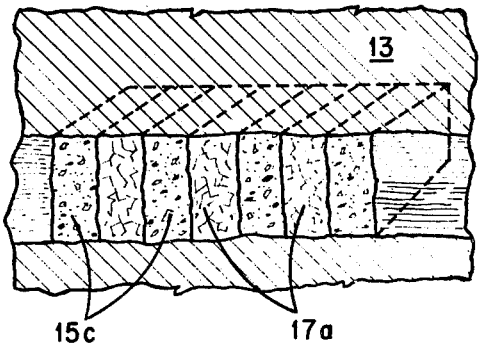

FIG. 3 shows spent or burned out retorts **15*b* after completion of the above-described retorting operation. The spent retorts are then backfilled with an aqueous slurry of burned spent shale, which is preferably obtained from surface retorting the shale initially mined out to create the necessary void space for rubblization, and the slurry is allowed to set into a cement-like material. If desired, Portland cement can be incorporated in the aqueous slurry to improve the cementing qualities thereof. The thus stabilized spent retorts 15*c* are shown in FIG. 4. The intervening column 17 of substantially intact shale can now be developed for in situ retorting by the same methods as described above for the initial retorts, that is, by sublevel caving and partial extraction of the shale, with stabilized retorts 15*c* acting as pillars to provide the necessary support. FIG. 5 shows the new retort 17*a* formed by fracturing intervening column 17. Shale oil is then recovered from retort 17*a* by the same techniques used for oil recovery from the initial retorts 15*a***.

Thus, the present invention provides a method for maximizing oil recovery from an underground formation. By the method of the present invention, resource recovery can be increased to essentially 100%. Also, the method of the present invention provides for the disposal of burned shale resulting from surface retorting of initially mined-out shale.

While an embodiment of the invention has been shown and described, various modifications and changes will be obvious to those skilled in the art without departing from the true spirit of the invention.

What I claim is:

1. A method for maximizing shale oil recovery from an underground formation which has previously been processed by in situ retorting such that there is provided in the formation a column of substantially intact oil shale intervening between adjacent spent retorts, which method comprises:

providing an aqueous slurry of burned spent shale;

substantially filling the spent retorts with said aqueous slurry;

permitting said aqueous slurry to harden into a cement-like substance, thereby stabilizing the spent retorts;

developing the intervening column of substantially intact oil shale for in situ retorting; and recovering shale oil from said developed intervening column by in situ retorting, the stabilized spent retorts providing support therefor.

2. A method according to claim 1 wherein the aqueous slurry is prepared from burned spent shale resulting from surface retorting of oil shale initially removed from the underground formation.

3. A method according to claim 1 wherein the intervening column of substantially intact oil shale is developed for in situ retorting by a subsurface mining process.

4. A method according to claim 3 wherein the subsurface mining process includes the steps of sublevel caving and partial extraction of the oil shale.

5. A method according to claim 1 wherein said aqueous slurry contains cement.

* * * * *